US006577051B2

(12) United States Patent
Kwon et al.

(10) Patent No.: US 6,577,051 B2
(45) Date of Patent: Jun. 10, 2003

(54) FLAT CATHODE RAY TUBE

(75) Inventors: Yong-Geol Kwon, Suwon (KR); Gui-Bae Kim, Soongnam (KR)

(73) Assignee: Samsung SDI Co., Ltd., Suwon (KR)

( * ) Notice: Subject to any disclaimer, the term of this patent is extended or adjusted under 35 U.S.C. 154(b) by 34 days.

(21) Appl. No.: 09/828,146

(22) Filed: Apr. 9, 2001

(65) Prior Publication Data

US 2001/0028211 A1 Oct. 11, 2001

(30) Foreign Application Priority Data

Apr. 10, 2000 (KR) ..... 2000-18564

(51) Int. Cl.[7] ..... H01J 29/81
(52) U.S. Cl. ..... 313/407; 313/402
(58) Field of Search ..... 313/407, 402, 313/404

(56) References Cited

U.S. PATENT DOCUMENTS 4,665,338 A * 5/1987 Inaba et al. ..... 313/407
5,698,938 A * 12/1997 Kim et al. ..... 313/407
5,898,259 A * 4/1999 Reyal ..... 313/407

FOREIGN PATENT DOCUMENTS

JP 7-296738 11/1995

* cited by examiner

*Primary Examiner*—Michael H. Day
*Assistant Examiner*—Sharlene Leurig
(74) *Attorney, Agent, or Firm*—Robert E. Bushnell, Esq.

(57) ABSTRACT

A flat cathode ray tube is provided. The flat cathode ray tube includes a shadow mask having a plurality of electron beam holes, a shadow mask frame having multiple-layered support members continuously connected, for supporting the shadow mask, and an inner shield connected to the shadow mask frame. The support member for supporting a shadow mask is solidified by forming multiple-layer laminates. Also, mobility is provided to the longer sides of the shadow mask, thereby easily applying a tension to the shadow mask.

27 Claims, 3 Drawing Sheets

FLAT CATHODE RAY TUBE

CLAIM OF PRIORITY

This application makes reference to, incorporates the same herein, and claims all benefits accruing under 35 U.S.C. §119 from an application for SHADOW MASK FRAME FOR CRT earlier filed in the Korean Industrial Property Office on Apr. 10, 2000 and there duly assigned Ser. No. 2000-18564.

BACKGROUND OF THE INVENTION

1. Field of the Invention

The present invention relates to a cathode-ray tube (CRT), and more particularly, to a flat cathode-ray tube that has a simplified process of connecting a shadow mask and a shadow mask frame that is solidified.

2. Description of the Background Art

Generally, a cathode-ray tube displays a picture by exciting a phosphor layer such that electron beams emitted from an electron gun lands on the phosphor layer through electron beam apertures of a shadow mask having a color selection function.

Only approximately 20% of the electron beam emitted from the electron gun pass through the electron beam apertures of the shadow mask to then land on the phosphor layer, and the remaining 80% collide with the shadow mask. The electron beams colliding with the shadow mask cause a doming phenomenon in which the shadow mask heated by the colliding electron beams experiences thermal deformation.

If the doming phenomenon occurs, the electron beams emitted later may not precisely land on the phosphor layer. Also, the shadow mask and the screen are formed to have a predetermined curvature, thereby narrowing the angle of viewing and distorting a picture at the periphery of the screen.

To solve the above-described problems, there has been developed a flat cathode-ray tube having a flat screen surface. The flat cathode-ray tube is constructed such that a panel where the phosphor layer is formed is formed in a flat type and the shadow mask is secured to the panel in a state in which a predetermined tension is applied to the shadow mask.

Japanese Patent Publication No. 7-296738, issued to Araya for Color Cathode-ray Tube discloses a flat cathode-ray tube having a shadow mask connected to a shadow mask frame. The shadow mask frame has a shadow mask supported to its one plane. The shadow mask has a plurality of holes, and is secured to the frame in a state in which a tension is applied thereto in every direction. A support member for supporting the lateral surfaces of the frame, is installed on the inner sides of the frame for the purpose of preventing restoration of the tension applied to the shadow mask.

The process of securing the shadow mask to the shadow mask frame will now be described briefly. In a state in which tension is applied to the whole surface of the shadow mask frame, the shadow mask is welded to the shadow mask frame. Then, in order to prevent the shadow mask from being deformed due to restoration of tension, rectangular panels are welded to the inner surface and rear surface of the shadow mask frame. Accordingly, the warping stress, by which the lateral surface of the shadow mask frame is warped inwardly, can be resisted, thereby maintaining the tensile strength of the shadow mask continuously.

However, since the cathode-ray tube is constituted by a plurality of structures, that is, the mask frame for primarily supporting the tensile strength of the shadow mask, and panels for supporting the mask frame, the configuration of the cathode-ray tube becomes complex, and a dispersion error in the design dimension may increase during the manufacture course thereof.

Also, since a welding process is employed in connecting the mask frame and an inner shield (not shown), the operational process becomes complicated, and much time and cost are required, resulting in poor manufacturability.

SUMMARY OF THE INVENTION

It is therefore an object of the present invention to provide a flat cathode-ray tube (CRT) having an improved strength by welding a shadow mask frame using boards of many folds, an improved tensile strength of a shadow mask supported by cutting the corners of the shadow mask frame, and enabling a simplified assembling operation with an inner shield.

It is another object to have a cathode-ray tube assembly that prevents the deformation of the mask frame.

It is yet another object to have a cathode-ray tube assembly that reduces the effects of the doming phenomenon.

It is still yet another object to have a flat cathode-ray tube that delivers a very high quality image with reduced distortions.

Accordingly, to achieve the above objects, there is provided a flat cathode-ray tube assembly including a shadow mask having a plurality of electron beam holes, a shadow mask frame having multi-layered support members continuously connected, for supporting the shadow mask, and an inner shield connected to the shadow mask frame.

Preferably, the support member has an L-shaped cross section and has a vertical part connected to the shadow mask and a horizontal part bent and axially extending from the vertical part. Also, a plurality of holes into which clips for connecting the inner shield are preferably formed on the horizontal part. Further, one plane of the shadow mask is preferably connected to rising edges of the multiple-layered plane of the support member by welding. The respective layers of the support member are preferably made of materials having the same coefficient of thermal expansion.

Since the flat cathode-ray tube having the aforementioned configuration is fabricated by a support member of multiple boards, it is remarkably strong compared to the case of using a single-board support member. Also, since the corners of the support member is partially cut, the support member can be pressed with a predetermined force, thereby easily applying tension to the shadow mask supported thereby. Further, since the shadow mask frame is simply assembled with the inner shield using clips in the holes formed on the horizontal part thereof, the manufacturing process of the cathode-ray tube can be simplified.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 4:
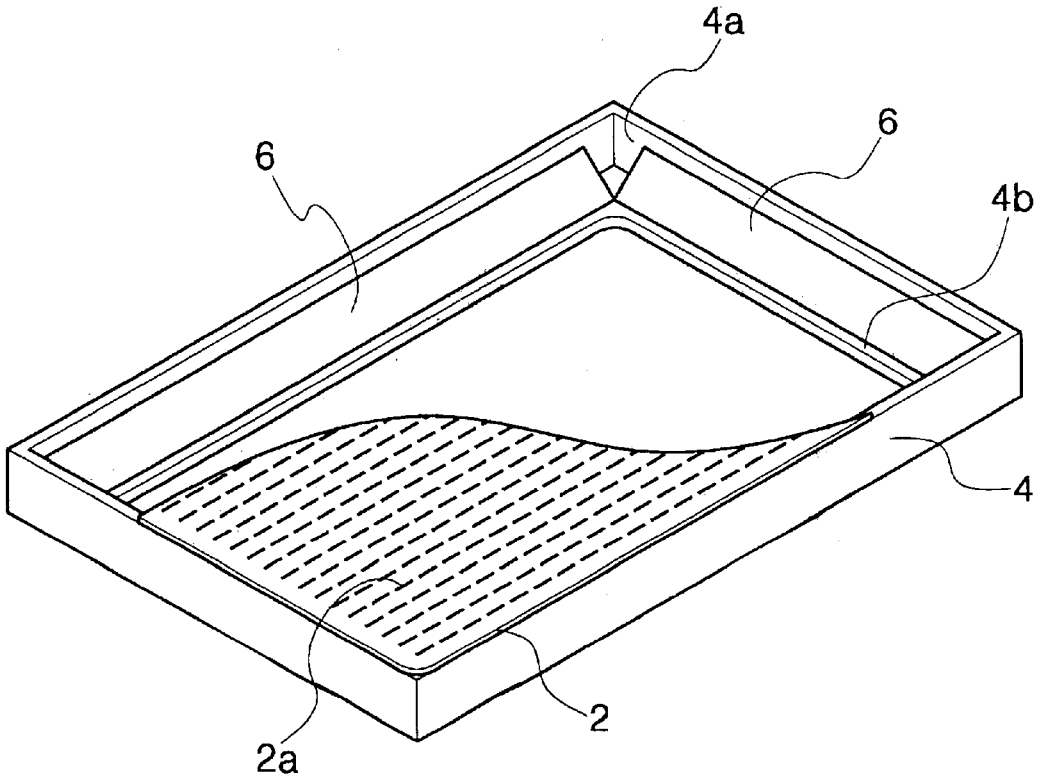
FIG. 4(PRIOR ART)
FIG. 4 is a perspective view of a shadow mask assembly of a conventional cathode-ray tube.

Turning now to the drawings, FIG. 4 shows a flat cathode-ray tube having a shadow mask 2 connected to a shadow mask frame 4. The structure of the shadow mask frame 4 is disclosed in Japanese Patent Publication No. 7-296738, issued to Jun for Color Cathode-ray Tube which will now be described.

The shadow mask frame 4 has a shadow mask 2 supported to its one plane. The shadow mask 2 has a plurality of holes 2*a,* and is secured to the frame 4 in a state in which a tension is applied thereto in every direction. A support member 6 for supporting the lateral surfaces of the frame 4, is installed on the inner sides of the frame 4 for the purpose of preventing restoration of the tension applied to the shadow mask 2.

The process of securing the shadow mask 2 to the shadow mask frame 4 will now be described briefly. In a state in which tension is applied to the whole surface of the shadow mask frame 4, the shadow mask 2 is welded to the shadow mask frame 4. Then, in order to prevent the shadow mask 2 from being deformed due to restoration of tension, rectangular panels 6 are welded to the inner surface 4*a* and rear surface 4*b* of the shadow mask frame 4. Accordingly, the warping stress, by which the lateral surface 4*a* of the shadow mask frame 4 is warped inwardly, can be resisted, thereby maintaining the tensile strength of the shadow mask 2 continuously.

However, since the cathode-ray tube is constituted by a plurality of structures, that is, the mask frame 4 for primarily supporting the tensile strength of the shadow mask 2, and panels 6 for supporting the mask frame 4, the configuration of the cathode-ray tube becomes complex, and a dispersion error in the design dimension may increase during the manufacture course thereof.

Figure 1:
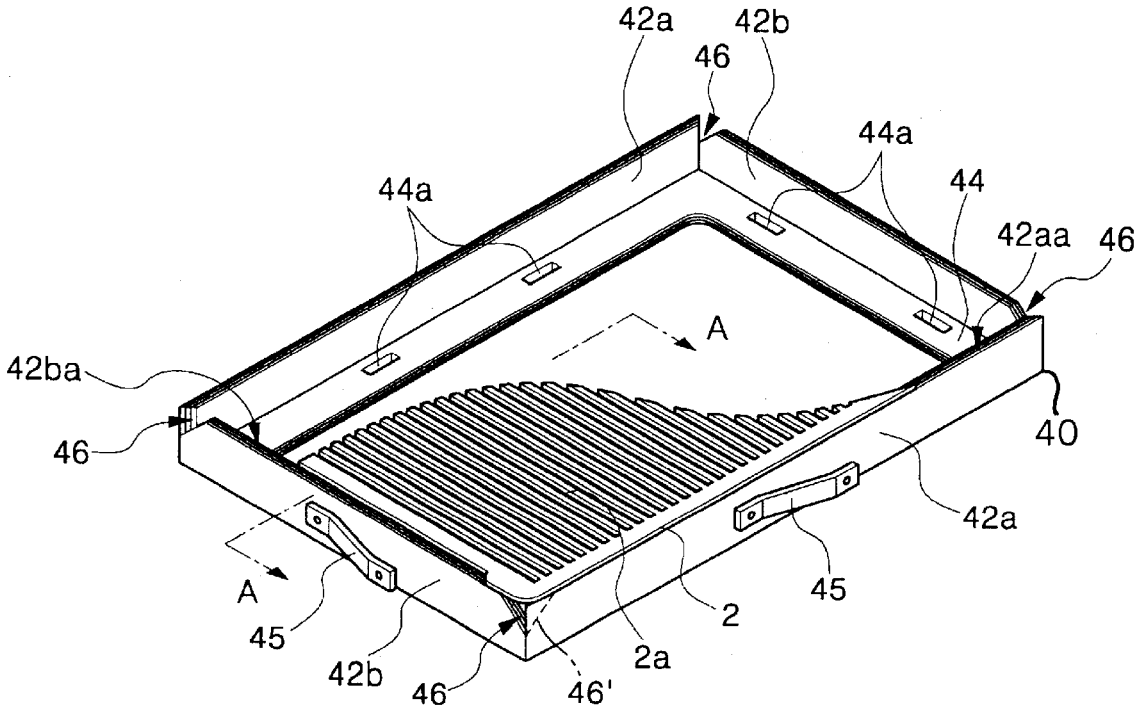
FIG. 1 is a perspective view of a shadow mask assembly according to an embodiment of the present invention.

A flat cathode-ray tube according to an embodiment of the present invention will now be described in detail with reference to the accompanying drawings. Referring to FIG. 1, a shadow mask frame 40 is constructed by continuously connected support members 38 each having a vertical part and a horizontal part to form substantially L-shaped cross sections, and the front and the rear surfaces of the shadow mask frame 40 are opened. The shadow mask 2 is fixedly supported to the rising edge of the vertical part of the mask frame 40 and the inner shield 120 (see FIG. 3) is mounted on the horizontal part 44 of the rear surface of the shadow mask frame 40.

The shadow mask 2 secured to the rising edges 42*aa* and 42*ba* of the vertical parts 42*a* and 42*b* of the mask frame 40 is a flat laminated structure, and has a plurality of electron beam holes 2*a* therein. The holes 2*a* may be dot-typed or slit-typed.

Figure 2:
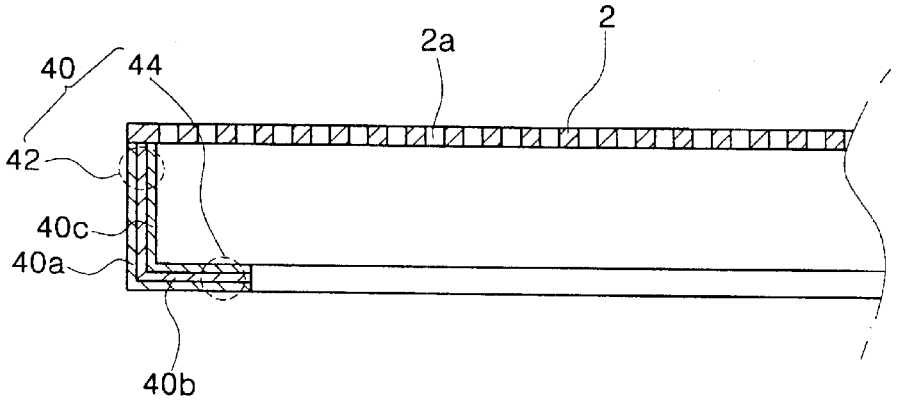
FIG. 2 is a cut-away sectional view, taken along the line A—A of FIG. 1.

The mask frame 40 is shaped of a rectangle having longer sides and shorter sides. As shown in FIG. 2, a vertical part 42 and a horizontal part 44 of the mask frame 40 is constructed such that three-fold L-shaped boards 40*a,* 40*b* and 40*c* are overlapped to then be welded, that is, the junctions of each longer side and shorter side are connected by welding. Also, the mask frame 40 may be constructed such that L-shaped boards in the rectangle having its longer sides and shorter sides integrally formed, are connected one by one by welding.

Springs 45 each coupled to a stud pin 114 of a face panel 110 (see FIG. 3), is secured to outer sides of the mask frame 40. The springs 45 connect the face panel 110 with the mask frame 40. Also, the springs 45 prevent trembling of the shadow mask 2 by reducing vibration applied to the mask frame 40.

The shadow mask 2 is secured to the rising edge of the vertical part 42 of the mask frame 40 by welding. If the temperature of the shadow mask 2 increase due to collision of electron beams, the heat is transferred to the support member 38, causing thermal deformation to the vertical part 42. If the thermal expansion coefficients of the respective boards 40*a,* 40*b* and 40*c* are not equal in the event of the thermal deformation, the welded portions also cause thermal deformation, so that the connected parts may be undesirably separated.

In order to prevent thermal deformation, the respective boards 40*a,* 40*b* and 40*c* forming the support member 38 are made of materials having the same coefficients of thermal expansion, preferably alloys containing iron as a main component, for increasing the hardness, and a predetermined amount of nickel, cobalt and the like.

At the corners of the support member 38, the ends of the shorter-side vertical parts 42*b,* facing the longer-side vertical parts 42*a,* have cut portions 46 of a predetermined depth, so that the mobility of the longer-side vertical part 42*a* and the shorter-side vertical part 42*b,* is allowed to some extent. The cut portions 46 are configured as described above, thereby pressing the longer-side vertical part 42*a* and the shorter-side vertical part 42*b* inwardly and outwardly. The cut portions 46 may be formed in the longer-side vertical part 42*a* (see dotted line 46') as well as in the shorter-side vertical part 42*b*.

Even after the shadow mask 2 is fixedly supported to the longer-side vertical part 42*a* of the support member 38, the longer side can be pressed outwardly to an extent by partially cutting the corners as described above, thereby applying a more secured tension to the shadow mask 2 supported by the support member 38.

The tensile strength is applied to the shadow mask 2 as follows. That is, before supporting the shadow mask 2, the longer-side vertical part 42*a* of the support member 38 is pressed inwardly, and the shadow mask 2 is then secured to the support member 38. Then, as the longer-side vertical part 42*a* of the support member 38 is elastically restored, the tension can be applied to shadow mask 2.

The horizontal part 44 of the support member 38 is connected to the inner shield 120 of the cathode-ray tube. The horizontal part 44 of the support member 38 and the horizontal part 120*b* of the inner shield 120 have been connected by welding. In order to overcome a cumbersome welding problem, in the mask frame 40 according to the present invention, a plurality of holes 44*a* are formed on the horizontal part 44 of the support member 38.

The holes 44*a* are not restricted in their shapes. In other words, when the inner shield 120 and the mask frame 40 are assembled, clips 50 are preferably inserted into the holes 120*a* formed on the inner shield 120 and the holes 44*a* formed on the horizontal part 44 of the mask frame 40, thereby facilitating the assembling work.

Figure 3:
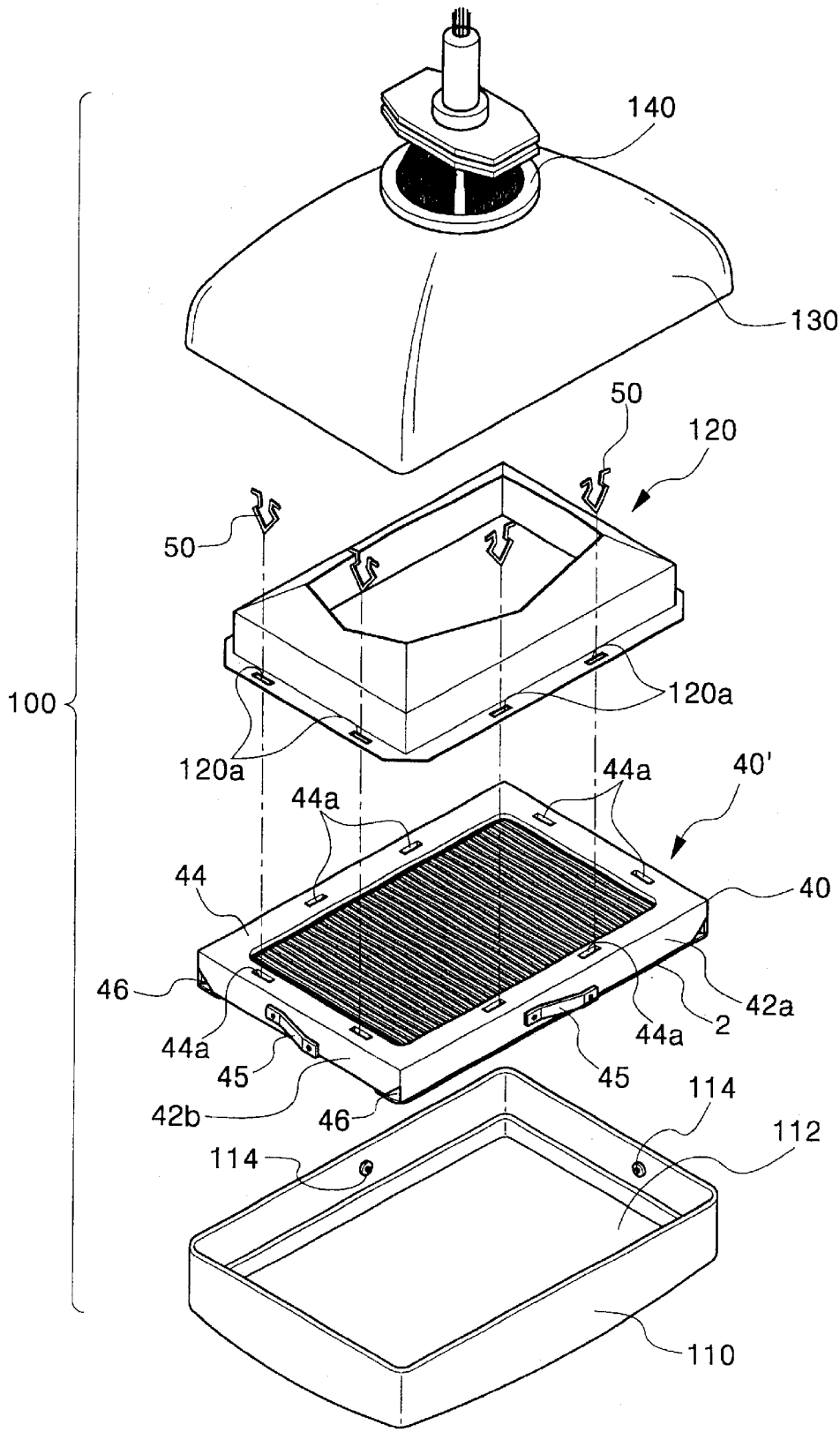
FIG. 3 is an exploded sectional view of a cathode-ray tube adopting the shadow mask assembly according to an embodiment of the present invention.

FIG. 3 is an exploded sectional view of a cathode-ray tube assembly 100 adopting the shadow mask assembly.

As shown in FIG. 3, the cathode-ray tube 100 includes a face panel 110 having a flat screen having a phosphor layer 112 on its inner surface, and a stud pin 114 fixedly installed on the inner surface of the face panel 110. A shadow mask assembly 40' is spaced a predetermined distance apart from the phosphor layer 112 on the inner surface of the face panel 110.

A resin film (not shown) made of, for example, a polyester film, is adhered by an adhesive agent on the front surface of the face panel 110, thereby preventing scattering of glass in the event of breakage of the face panel 110 due to external shock. The inner shield 120 is assembled in rear of the shadow mask assembly 40', and a funnel 130 with the inner shield 120 and the shadow mask assembly 40' incorporated therein, is assembled to the face panel 110. A deflection yoke 140 for deflecting the electron beams emitted from an electron gun (not shown) to a predetermined position, is mounted on the neck portion of the funnel 130.

The shadow mask assembly 40' includes the shadow mask frame 40 having the springs 45 respectively connected to the stud pins 114, the springs 45 provided on the outer peripheral surfaces of the shadow mask frame 40. The shadow mask 2 is fixedly installed to the rising edges 42*aa* and 42*ba* of the vertical parts 42*a* and 42*b*, respectively, of the shadow mask frame 40. The shadow mask 2 is secured to the end of the phosphor layer side of the mask frame 40, while applying a tension to the shadow mask 2.

The tension of the shadow mask 2 is produced by thermally expanding the shadow mask 2 by heating the shadow mask 2 at a predetermined temperature, higher than the temperature applied to the shadow mask 2 by the operation of the cathode-ray tube when the shadow mask 2 is mounted on the mask frame 40, welding the shadow mask 2 to the rising edges 42*aa* and 42*ba* of the vertical parts 42*a* and 42*b* of the mask frame 40 and then cooling.

Also, the tension of the shadow mask 2 may be obtained by compressively deforming the mask frame 40 inwardly within the allowance of elastic deformation of material, securing the shadow mask 2 to the rising edges 42*aa* and 42*ba* of the vertical part 42 of the mask frame 40 and then restoring the shadow mask 2 into its original position.

As described above, in the course of securing the shadow mask 2, the shadow mask 2 may be secured to the rising edges 42*aa* and 42*ba* of the vertical parts 42*a* and 42*b*, respectively, of the mask frame 40 by bonding or welding. In the case of securing the shadow mask 2 by welding, seam welding or laser welding is preferably employed to the rising edges 42*aa* and 42*ba* of the vertical parts 42*a* and 42*b* of the mask frame 40 along the periphery of the shadow mask 2.

Before the shadow mask assembly 40' is connected with the funnel 130, it is assembled with the inner shield 120. In the inner shield 120, a plurality of holes 120*a* are formed on a portion contacting with the horizontal part 44 of the mask frame 40. The holes 120*a* are formed at positions corresponding to the holes 44*a* formed on the horizontal part 44 of the mask frame 40.

The assembling work of the shadow mask assembly 40' and the inner shield 120 is achieved by inserting the clips 50 into the holes 44*a* formed on the horizontal part 44 of the mask frame 40 and the holes 120*a* formed on the inner shield 120. The clips 50 accommodate quick assembly and disassembly of the inner shield 120 from the shadow mask frame 40 by pressing inwards a top portion of the clips 50 and inserting through holes 120*a* and 44*a* and releasing the clips to secure the shadow mask frame 40 to the inner shield 120.

The above-described assembly work allows the inner shield 120 or the shadow mask assembly 40' to be repaired or recycled by simply disassembling the clips 50 in the case where the inner shield 120 or the shadow mask assembly 40' are damaged.

The above-described mask frame 40 has an increased strength in supporting the shadow mask 2 by using L-shaped support member 38 with boards of many-folds connected by welding. Also, the corners of the support member 38 are partially cut to easily press the longer-side vertical part 42*a* and the shorter-side vertical part 42*b*, thereby effectively applying a tension to the shadow mask 2.

Also, simplified assembly work is possible by using the clips 50 inserted into the holes 120*a* formed on the inner shield 120 and the holes 44*a* formed on the horizontal part 44 of the mask frame 40, thereby reducing the number of operating steps.

As described above, according to the flat cathode-ray tube of the present invention, a support member for supporting a shadow mask is solidified by forming multiple-layer laminates. Also, mobility is provided to the longer sides of the shadow mask, thereby easily applying a tension to the shadow mask. Further, holes are formed on the horizontal part of the mask frame and clips are inserted into the holes when the mask frame is assembled with the inner shield, thereby enabling simplified assembly work, causing a reduction in operation time and improvement in the ability to manufacture.

Although the invention has been described with respect to a specific illustrative embodiment, it is not to be construed as limitations and additional modifications and equivalents thereof will readily occur to those skilled in the art from the invention disclosed herein. Therefore, the actual scope of the invention is intended to be defined in the appended claims.

What is claimed is:

1. A flat cathode-ray tube, comprising:

a shadow mask having a plurality of electron beam holes;

a shadow mask frame having multiple-layered support members continuously connected, supporting said shadow mask; and an inner shield connected to said shadow mask frame, with one plane of said shadow mask being connected to rising edges of the multiple-layered plane of said support members.

2. The flat cathode-ray tube according to claim 1, with each of said support members having an L-shaped cross section and having a vertical part connected to said shadow mask and a horizontal part bent and axially extending from said vertical part.

3. The flat cathode-ray tube according to claim 2, further comprising a clip inserted through said inner shield and a hole formed on said horizontal part to connect said inner shield to said horizontal part of said support member.

4. The flat cathode-ray tube according to claim 2, with the one plane of said shadow mask being connected to rising edges of the multiple-layered plane of said support members by welding.

5. The flat cathode-ray tube according to claim 2, with the rising edges of the multiple-layered plane of said support members being the plane formed by the multiple layers being continuously connected.

6. The flat cathode-ray tube according to claim 1, with the respective layers of said support members being made of materials having the same coefficient of thermal expansion.

7. The flat cathode-ray tube according to claim 1, with said support members having corners partially cut accommodating mobility of said support members.

8. The flat cathode-ray tube according to claim 1, further comprising a resilient member on a side surface of said shadow mask frame coupled to a face panel to reduce vibration applied to said shadow mask.

9. The flat cathode-ray tube according to claim 1, with said multiple-layered support members comprising of iron.

10. The flat cathode-ray tube according to claim 9, with said multiple-layered support members further comprising of a predetermined amount of nickel and cobalt.

11. The flat cathode-ray tube according to claim 2, with said vertical part comprising of a short side and a long side, said long side coupled with said short side, said short side having a cut portion of a predetermined depth, said cut portion accommodating mobility of said support members.

12. The flat cathode-ray tube according to claim 11, with said long side having a cut portion of a predetermined depth.

13. The flat cathode-ray tube according to claim 11, with said cut portions being on the corners of said short side.

14. The flat cathode-ray tube according to claim 1, with said multiple-layers of said support members being a flat laminate structure.

15. An apparatus, comprising of a shadow mask frame having a support member supporting a shadow mask of a cathode-ray tube, said support member comprising of a plurality of layers, with one plane of said shadow mask being connected to rising edges of the multiple-layered plane of said support members.

16. The apparatus according to claim 15, with the respective layers of said support member being made of materials having the same coefficient of thermal expansion.

17. The apparatus according to claim 16, with said support member having corners partially cut accommodating mobility of said support members.

18. The apparatus according to claim 17, further comprising:

an inner shield; and a clip inserted through a hole in said inner shield and a hole formed on said support member to secure said inner shield to said support member.

19. The apparatus according to claim 18, with said support member having rising edges of each one of said plurality of layers connecting with said shadow mask.

20. The apparatus according to claim 19, with said support member having an L-shaped cross section and a vertical part connected to said shadow mask and a horizontal part bent and axially extending from said vertical part.

21. The apparatus according to claim 20, with said plurality of layers of said support members being a flat laminate structure comprising of a metallic material.

22. A method, comprising the steps of:

forming support members having a plurality of layers and rising edges, said support members continuously connected to form a frame supporting a shadow mask of flat cathode-ray tube, with one plane of said shadow mask being connected to rising edges of a plane of said plurality of layers of said support member;

coupling said shadow mask to said rising edges of said support member; and coupling an inner shield to said support members.

23. The method according to claim 22, with said step of forming said support members, further comprising of said support member having an L-shaped cross section and having a vertical part connected to said shadow mask and a horizontal part bent and axially extending from said vertical part.

24. The method according to claim 23, with said step of coupling said inner shield, comprising of inserting a clip through said inner shield and a hole formed on said horizontal part to connect said inner shield to said horizontal part of said support member.

25. The method according to claim 23, with the one plane of said shadow mask being connected to said rising edges of a plane of said plurality of layers of said support member by welding.

26. The method according to claim 25, with the respective layers of said support member being made of materials having the same coefficient of thermal expansion.

27. The method according to claim 26, with said step of forming said support members further comprising of partially cutting the corners of one of said support members accommodating mobility of one of said support members.

* * * * *